United States Patent [19]

Hultgren

[11] Patent Number: 4,460,500

[45] Date of Patent: Jul. 17, 1984

[54] METHOD FOR FINAL TREATMENT OF RADIOACTIVE ORGANIC MATERIAL

[75] Inventor: Ake Hultgren, Nyköping, Sweden

[73] Assignee: Studsvik Energiteknik AB, Nyköping, Sweden

[21] Appl. No.: 358,692

[22] Filed: Mar. 16, 1982

[30] Foreign Application Priority Data

Mar. 20, 1981 [SE] Sweden ..... 8101801

[51] Int. Cl.[3] ..... G21F 9/16

[52] U.S. Cl. ..... 252/628; 252/626; 252/629

[58] Field of Search ..... 252/628, 629, 626, 631, 252/632

[56] References Cited

U.S. PATENT DOCUMENTS

| | | | |
|---|---|---|---|
| 3,375,202 | 3/1968 | Laveissiere et al. | 252/626 |
| 4,053,432 | 10/1977 | Tiepel et al. | 252/626 |
| 4,118,317 | 10/1978 | Neeb et al. | 252/626 |
| 4,122,048 | 10/1978 | Buchwalder et al. | 252/628 |

FOREIGN PATENT DOCUMENTS

| | | | |
|---|---|---|---|
| 2726087 | 4/1978 | Fed. Rep. of Germany | 252/629 |
| 54-157000 | 12/1979 | Japan | 252/626 |

*Primary Examiner*—Deborah L. Kyle

*Attorney, Agent, or Firm*—Burns, Doane, Swecker & Mathis

[57] ABSTRACT

Radioactive waste, such as expended radioactive ion exchanger mass, can be transformed in a continuous process to a stable state for final storage in the following manner. The waste is mixed with an aqueous solution of a chemical agent which liberates radioactive substances from the waste, and with an inorganic sorbent for the thus liberated radioactive substances. The mixture is now dried and calcinated during the supply of air or oxygen so that the organic material is combusted. Subsequently the calcined material is placed in a refractory storage container, which is now heated with its contents to a temperature at which said material sinters or fuses to a stable product.

10 Claims, 1 Drawing Figure

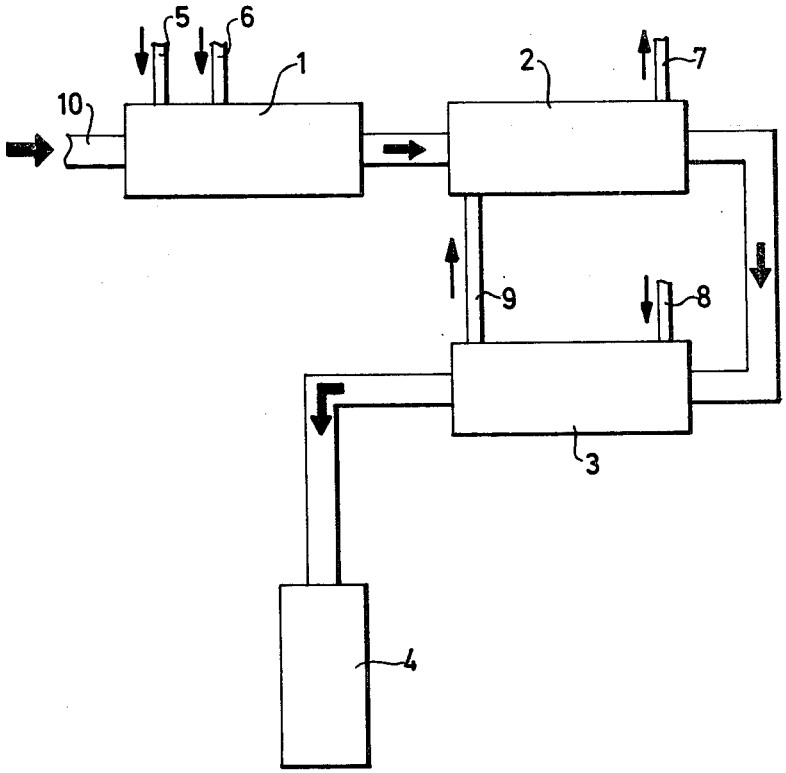
5
6
1
2
7
10
9
8
3
4

METHOD FOR FINAL TREATMENT OF RADIOACTIVE ORGANIC MATERIAL

The invention relates to a method for the final treatment of radioactive organic material, primarily consumed radioactive ion exchanger mass, for transforming the material into a stable form for permanent storage.

In the operation of nuclear power stations, organic ion exchangers are used for continuous cleaning in cooling water circuits and for cleaning the water in basins in which used nuclear fuel is stored. The ion exchangers are granulate, i.a. for cleaning the primary cooling circuit, and powdery, e.g. for cleaning condensate circuits and basin water. After use, the ion exchanger masses constitute a radioactive waste which must be treated to give it a stable form allowing safe permanent storage over several hundred years, when the radioactivity has decreased to a level where there are no risks. Other radioactive wastes occurring during the treatment of different waste waters are sludge and vaporization concentrates. Quantitatively however the ion exchanger masses dominate this waste category entirely.

Two methods are used today for giving these wastes a form suitable for transport and permanent storage: encapsulation in cement or bitumen. Both methods have drawbacks: the volume increases 4–20 times for encapsulating in cement and about twice for encapsulating in bitumen. Stability against leaching is not so good for cement, and with bitumen fire hazards, inter alia, require particular attention.

New methods of treatment have therefore been developed, but are not yet established industrially. One such method is combustion of the ion exchanger mass, inter alia in fluidized bed furnaces. The method has been found to give problems with the volatility of the radioactive substances, primarily $^{137}Cs$, and therefore requires an extensive flue gas cleaning system. It can therefore not be said to have reached industrial maturity yet.

In another method under development the radioactive contents in the ion exchanger masses are transferred in packed columns to an inorganic sorbent, which after drying and sintering gives a stable product. The method has been tested on a small scale (a few liters), where it has functioned satisfactory. However, it requires batchwise charging and emptying of the columns and subsequent combustion of the ion exchanger mass with separate disposal of the ash.

The invention is aimed at providing a method which decreases the radioactive organic material volume to 1/5–1/10 of the original volume, as well as giving the material a stable form suitable for final storage. Another object of the invention is to propose a method enabling a continuous and closed unbroken processing line without intermediate products needing to be taken out or introduced into the process.

The method in accordance with the invention is characterized in that the material is mixed with an aqueous solution of a chemical agent which liberates the radioactive substances bound in the material, as well as with an inorganic sorbent for the thus liberated radioactive substances, subsequent to which the mixture is dried and calcinated while admitting air or oxygen, so that the organic material is combusted, the calcinated material being then collected in a refractory storage container, which, together with its contents, is heated to a temperature at which the material sinters or is converted or fused to a stable product.

As chemical agent we prefer a complex-forming acid such as phosphoric acid and organic acids such as citric, tartaric or oxalic acid, or a salt of such an acid, or a mixture of two or more of these substances. It is known that such complex-forming acids or salts can form complex compounds with many of the radioactive metal ions, e.g. cobalt, zinc and nickel ions, which are present in expended ion exchangers from nuclear power stations.

The complex-forming acid or salt should be supplied in an amount such that the radioactive substances are rapidly liberated from the organic material without their sorption on the inorganic sorbent supplied being prevented or made difficult.

As inorganic sorbent we prefer a titanate or titanium hydroxide, a zirconate or zirconium hydroxide or zirconium phosphate, an aluminate or aluminium hydroxide or aluminium phosphate, an aluminosilicate such as bentonite or a natural or synthetic zeolite, calcium phosphate or a mixture of two or more of these substances. The sorbent should be supplied in an amount such that it completely sorbs the radioactive substances and is also capable of incorporating the ash from combustion of the organic material. The sorbent suitably has a particle size of 10–100 microns. The sorbent can be considerably more fine-grain here than what is possible with the use of packed columns.

The explanation of the good technical effect of the method in accordance with the invention would appear to be the following, in using complex-forming acids or salts as chemical agents. The acid forms complex compounds with one or more of the radioactive metal ions in the ion exchanger mass, these compounds having a stability such that practically all the radioactive substances leave the ion exchanger mass. The complex compounds formed are dissociated to metal ions, which in turn are sorbed on the inorganic sorbent. During the latter part of the drying step, or during the earlier part of the calcining step, the complex compounds will be thermically decomposed and the metal ions on the inorganic sorbent surface will be stably incorporated with the sorbent during the continuation of the calcination. Radioactive cesium will be transferred from the organic ion exchanger to the inorganic sorbent during this process, and will be stably incorporated therewith during the calcination. It may therefore be said that the invention signifies that the radioactive substances are transformed from a less stable form to a more stable form, which withstands sintering without being vaporized.

The material is suitably mixed at a temperature of 20°–70° C. A preferred mixing temperature is about 50° C. Drying is suitably carried out at 100°–150° C., preferably at 100°–110° C., The mixture is suitably agitated during drying to retain a homogenous composition.

Calcination suitably takes place at 300°–900° C., during successive temperature increase. The temperature should be increased rather slowly, which contributes to the material retaining its homogenity. Air or oxygen is supplied for combustion of the organic material. The heat of combustion is not sufficient to provide the desired temperature, and therefore heat must be supplied.

The hot calcinated material comprises a mixture of ash from the combusted organic material and inorganic sorbent containing the radioactive material. This hot material is suitably transferred directly to a sintering vessel, preferably comprising a refractory steel or ceramic material. The container and its contents are heated to a temperature such that the contents is converted, i.e. sinters or fuses, to a substantially homogenous, dense and stable product. A suitable temperature is 1000°–1300° C., and a suitable time is 2–6 hours. The container with its contents is now allowed to cool, and can subsequently be transferred to terminal storage for radioactive waste.

The drawing schematically illustrates how the method can be executed. The radioactive organic waste material, is added through a supply pipe 10 and is mixed at 20°–70° C. in a mixing step 1, with an aqueous solution of a chemical agent supplied through a conduit 5 and an inorganic sorbent supplied through a conduit 6, suitably supplied in the form of a suspension in water. The mixture is transferred to a drying step 2 where drying takes place at 100°–110° C. Required drying heat is supplied conventionally, and water departs through a conduit 7 in the form of steam. The dried mixture is transferred to a step 3 for calcination and combustion. The temperature is successively increased here from 300° to a final temperature of between 500° and 900° C. If the step 3 includes a tubular furnace through which the material can be slowly fed, then a controlled temperature increase can take place, e.g. by exterior heating of the tube, or by internal heating, e.g. combustion of gas or oil. Air or oxygen is supplied through a conduit 8 in an amount such that the organic material will be completely combusted. The flue gases formed are recycled through conduit 9 to the drying step 2, where the heat content of the gas contributes to the drying, and possible entrained active material is sorbed on the inorganic sorbent. The hot material from step 3 is transferred to a container in a sintering step 4, where sintering takes place at 1000°–1300° C. After cooling, the container with sintered content is ready for terminal storage.

EXAMPLE

A batchwise operation of the claimed process on a small scale may be carried out in this way:

A flask contained 24 ml sodium tartrate solution having a concentration of 0.6M, 10 ml granular ion exchanger mass, and 3 grams of an inorganic sorbent consisting of 1 gram bentonite and 2 grams sodium titanate. The ion exchanger originated from a so-called mixed bed, and consisted of 40 percent by weight cation exchanger and 60 percent by weight anion exchanger. The ion exchanger had been used for the purification of the primary cooling circuit water in a nuclear reactor of the boiling water type. It contained radioactive substances, mainly $^{137}Cs$ and $^{60}Co$ in a quantity equivalent to 37 MBq (1 m Ci). The flask with its contents was shaken for 10 minutes. After the shaking an equilibrium was reached, in which Cs and Co were distributed in this way

| | Solution | Ion exchanger | Titanate | Bentonite | Total |
|---|---|---|---|---|---|
| Cs | 7 | 6 | 58 | 29 | 100 |
| Co | 0.6 | 1.0 | 98.35 | 0.05 | 100 |

The mixture was now evaporated at 110° C. until a dry mass remained. The dry mass was put into a horizontal glass tube, Oxygen was brought to flow through the glass tube, while the tube was heated from the outside to 800° C., was kept at said temperature for 30 minutes, and was allowed to cool. The combusted material from the glass tube was transferred to a graphite crucible and was sintered in said crucible for two hours at 1200° C.

The gamma radiation as emitted by $^{137}Cs$ was measured in the cooler portion of the glass tube, and in the gas leaving the glass tube during the combustion. It was found that less than 1% of the cesium content was released from the solid material. The cesium release was very low also during the sintering process. Leaching experiments showed that the leach of the radioactive isotopes from the sintered product was very low.

I claim:

1. A method for final treatment of a spent radioactive organic ion exchanger mass, for transforming the material to stable form for terminal storage, characterized in that the material is mixed with an aqueous solution of a chemical agent which liberates radioactive substances bound in the material, as well as with an inorganic sorbent for the thus liberated radioactive substances, the mixture being subsequently dried and calcined while air or oxygen is supplied, so that the organic matter is combusted, the calcinated material subsequently being placed in a refractory storage vessel which is then heated together with its contents to a temperature at which the material sinters or fuses to a stable product.

2. Method as claimed in claim 1, wherein said chemical agent which liberates radioactive substances bound in the material is a complex-forming agent selected from the group consisting of phosphoric acid, citric acid, tartaric acid, oxalic acid, a salt of phosphoric acid, a salt of citric acid, a salt of tartaric acid, a salt of oxalic acid, and mixtures of any of the foregoing.

3. Method as claimed in claim 1, wherein said inorganic sorbent is selected from the group consisting of a titanate, titanium hydroxide, a zirconate, zirconium hydroxide, zirconium phosphate, an aluminate, aluminum hydroxide, aluminum phosphate, an alumino silicate, a natural zeolite, a synthetic zeolite, calcium phosphate, and mixtures of any of the foregoing.

4. Method as claimed in claim 1, in which mixing takes place at a temperature of 20°–70° C.

5. Method as claimed in claim 1, in which the temperature during calcination is increased from 300° C. to a final temperature of between 500° and 900° C.

6. Method as claimed in claim 1, in which the flue gas from the calcination-combustion step are refluxed to the drying step for cleaning the gas.

7. Method as claimed in claim 1, in which the material after calcination-combustion is sintered or fused, in a final storage container, at 1000°–1300° C. to a stable product.

8. Method as claimed in claim 1 wherein said chemical agent which literates radioactive substances comprises sodium tartrate.

9. Method as claimed in claim 1 wherein said inorganic sorbent comprises bentonite.

10. Method as claimed in claim 1 wherein said inorganic sorbent comprises sodium titanate and bentonite.

* * * * *